United States Patent [19]

Yamada et al.

[11] 4,024,903

[45] May 24, 1977

[54] EVAPORATIVE COOLING METHOD BY NATURAL CIRCULATION OF COOLING WATER

[75] Inventors: Takeo Yamada; Kazuo Kunioka; Shunichi Sugiyama; Toyokazu Teramoto, all of Yokohama, Japan

[73] Assignee: Nippon Kokan Kabushiki Kaisha, Tokyo, Japan

[22] Filed: Mar. 29, 1976

[21] Appl. No.: 671,396

Related U.S. Application Data

[63] Continuation of Ser. No. 573,563, May 1, 1975, abandoned.

[30] Foreign Application Priority Data

May 20, 1974 Japan ..... 49-55379
Sept. 27, 1974 Japan ..... 49-110460

[52] U.S. Cl. ..... 165/1; 165/106; 122/7 R; 266/190; 432/77; 432/233

[51] Int. Cl.[2] ..... F28D 15/00

[58] Field of Search ..... 266/32; 165/1 R, 105, 165/106; 122/7 A, 7 R; 432/77, 233, 234; 123/41.2, 41.21, 41.27

[56] References Cited

UNITED STATES PATENTS

| | | | |
|---|---|---|---|
| 2,681,643 | 6/1954 | Hull | 123/41.21 |
| 3,601,382 | 8/1971 | Sandri | 122/7 |
| 3,693,708 | 9/1972 | Andoniev et al. | 266/32 |
| 3,704,747 | 12/1972 | Andoniev et al. | 266/32 |
| 3,723,632 | 3/1973 | Beizerov | 266/32 |
| 3,818,870 | 6/1974 | Andoniev et al. | 266/32 |

FOREIGN PATENTS OR APPLICATIONS

| | | | |
|---|---|---|---|
| 1,236,637 | 11/1964 | Germany | |
| 1,458,787 | 10/1965 | Germany | |
| 159,869 | 4/1964 | U.S.S.R. | 266/32 |

OTHER PUBLICATIONS

"Russian Designed Stave Coolers", *Iron and Steel*, Nov. 1972, pp. 98–101.

*Primary Examiner*—William L. Freeh
*Assistant Examiner*—Robert E. Garrett
*Attorney, Agent, or Firm*—Flynn & Frishauf

[57] ABSTRACT

In an evaporative cooling method by natural circulation of cooling water by the use of an evaporative cooling device comprising a cooling pipe fitted to an object to be cooled and a steam separator drum arranged above said cooling pipe, said cooling pipe and said steam separator drum being connected together by a downcomer and a riser, the cooling water in said cooling pipe is kept in complete liquid state and part of cooling water is evaporated only in said riser and said steam separator drum by setting parameters to satisfy the following formula:

$$Q/V\cdot\rho\cdot c<\Delta T_{eq}(P_o, Ph_3)$$

Where $Q$ : Thermal load acting on said cooling pipe
$V$ : Amount of circulated cooling water in said cooling pipe
$\rho$ : Lensity of cooling water
$c$ : Specific heat of cooling water
$P_o$ : Pressure of said steam separator drum
$Ph_3$ : Pressure of cooling water in the uppermost part of said cooling pipe
$\Delta T_{eq}$ ($P_o$, $Ph_3$) : Boiling equilibrium temperature difference between $P_o$ and $Ph_3$.

8 Claims, 14 Drawing Figures

EVAPORATIVE COOLING METHOD BY NATURAL CIRCULATION OF COOLING WATER

This is a continuation of application Ser. No. 573,563, filed May 1, 1975 now abandoned.

FIELD OF THE INVENTION

This invention relates to an improved method of evaporative-cooling such objects as a blast furnace and a heating furnace by natural circulation of cooling water.

BACKGROUND OF THE INVENTION

Forced water cooling and evaporative cooling are known as methods of cooling such objects as a blast furnace and a heating furnace for heating steel ingots, steel plates and sheets, steel pipes, etc.

Forced water cooling is a method of cooling an object by circulating cooling water through a cooling pipe attached to the object to be cooled by means of a circulating pump. In this method, cooling water circulates in the liquid state and is substantially free from evaporation. Although the forced water cooling method is of wide application, it requires large quantities of cooling water, thereby not only necessitating associated facilities such as reservoirs and cooling towers, but also requiring much cost in operating and maintaining circulating pumps, cooling tower pumps, fans, etc. In addition, the temperature of cooling water at the cooling pipe inlet is as low as about 20° C to about 40° C, resulting in a large heat loss due to cooling. Besides, the low temperature of cooling water at the cooling pipe outlet makes it difficult to recover heat from cooling water and to utilize recovered heat.

As a cooling method devoid of the above-mentioned disadvantages, evaporative cooling is widely used in Europe. This method comprises circulating cooling water through an evaporative cooling device comprising a cooling pipe fitted to an object to be cooled and a steam separator drum arranged above said cooling pipe, said cooling pipe and said steam separator drum being connected together by a downcomer and a riser, to cool said object to be cooled, separating steam generated from cooling water through heat exchange with said object to be cooled from cooling water by means of said steam separator drum, discharging said steam to outside the circuit, and replenishing cooling water from outside the circuit in an amount corresponding to the quantity of the steam discharged. This evaporative cooling method has many advantages over the above-mentioned forced water cooling method as follows:

a. The amount of cooling water used is very small.

b. Heat is recovered in the form of steam having a large heat capacity, thus permitting easy recovery of heat from cooling water and easy utilization of recovered heat.

c. Since the temperature of cooling water at the cooling pipe inlet is as high as about 100° C to about 200° C, heat loss due to cooling is small.

d. It is unnecessary to provide associated facilities such as reservoirs and cooling towers.

Said evaporative cooling methods are classified into the forced circulation system and the natural circulation system. FIGS. 1 and 2 are respective schematic drawings of these systems. In both drawings, 1 designates a steam separator drum, 2 designates a downcomer, 3 designates an object to be cooled such as a blast furnace and a heating furnace, 4 designates a cooling pipe fitted to said object to be cooled, 5 designates a riser, and 6 (FIG. 1) designates a circulating pump.

In the evaporative cooling method by forced circulation, as shown in FIG. 1, cooling water is forcedly circulated by means of a circulating pump 6 arranged between a steam separator drum 1 and a cooling pipe 4. Therefore, even if a bend portion composed of an ascending part and a descending part is included in said cooling pipe 4, steam from cooling water does not stagnate, thus eliminating the possibility of causing "burnout" of said cooling pipe. When steam from cooling water is deposited on the inner surface of a cooling pipe, poor heat conduction of the cooling pipe is caused, and this leads to heat damage to the cooling pipe due to overheating. This phenomenon is called "burnout". Accordingly, the evaporative cooling method by forced circulation is adopted in applications where said bend portion must be provided in said cooling pipe as in the case of a walking beam furnace. However, this method needs said circulating pump 6, thus requiring much equipment cost and running cost. Moreover, since it is possible that said cooling pipe will be burned out if said circulating pump is stopped by an electric power failure and from other causes, a standby circulating pump driven by another power source must be provided.

On the contrary, in the evaporative cooling method by natural circulation, cooling water naturally circulates through the circulation force generated from the difference in density between the cooling water in a downcomer 2 and the cooling water in a riser 5, as shown in FIG. 2, requiring no circulating pump as in the case of the above-mentioned forced circulation system. More specifically, since the cooling water in said downcomer 2 is in the liquid state, it has a larger density than the cooling water containing vapor in said riser 5 in the gaseous and aqueous states, thus leading to natural circulation of cooling water due to difference in density. This natural circulation system has advantages in such points that equipment and running costs are low as compared with the above-mentioned forced circulation system, and further there is no possibility of the above-mentioned burnout even if an electric power failure and other situations take place. On the other hand, this method has a disadvantage that the above-mentioned burnout may be caused by deposition of steam films on said bend portion due to fluctuations of thermal load acting on said cooling pipe when said cooling pipe is provided with said bend portion. Therefore, this natural circulation system is adopted in applications where a horizontal beam is used and it is unnecessary to provide said cooling pipe with said bend portion composed of an ascending part and a descending part as in the case of a pusher furnace.

As mentioned above, although the evaporative cooling method by natural circulation is industrially most advantageous as a whole, such evaporative cooling methods by natural circulation have not so far been developed, which can be adopted in applications where said bend portion must be included in said cooling pipe.

SUMMARY OF THE INVENTION

Therefore, an object of this invention is to provide an improved evaporative cooling method by natural circulation of cooling water that can be adopted even in applications where a bend portion composed of an ascending part and a descending part is provided.

Another object of this invention is to provide an improved evaporative cooling method by natural circulation of cooling water that can reduce the amount of steam generated in a riser and in a steam separator drum.

A further object of this invention is to provide an improved evaporative cooling method by natural circulation of cooling water that enables a steam separator drum to be set in a relatively low position.

In an evaporative cooling method by natural circulation of cooling water comprising the steps of using an evaporative cooling device comprising a cooling pipe fitted to an object to be cooled and a steam separator drum arranged above said cooling pipe, said cooling pipe and said steam separator drum being connected together by a downcomer and a riser, separating steam generated within the circuit of said evaporative cooling device from cooling water by means of said steam separator drum, discharging said steam to outside the circuit, replenishing cooling water from outside the circuit in an amount corresponding to the quantity of the steam discharged, keeping the cooling water in said cooling pipe in complete liquid state and causing part of cooling water to evaporate only in said riser and in said steam separator drum by setting parameters to satisfy the following formula:

$$Q/V \cdot \rho \cdot c < \Delta T_{eq}(P_o, Ph_3)$$

Where, $Q$: Thermal load acting on said cooling pipe
$V$: Amount of circulated cooling water in said cooling pipe
$\rho$: Density of cooling water
$c$: Specific heat of cooling water
$P_o$: Pressure in said steam separator drum
$Ph_3$: Pressure of cooling water in the uppermost part of said cooling pipe
$\Delta T_{eq}$ $(P_o, Ph_3)$: Boiling equilibrium temperature difference between $P_o$ and $Ph_3$.

This invention is characterized by replenishing cooling water from outside the circuit in an amount corresponding to the quantity of said steam discharged, totally to the middle of said downcomer, or by distributing to both said stream separator drum and the middle of said downcomer.

DETAILED DESCRIPTION OF PREFERRED EMBODIMENTS

Figure 1:
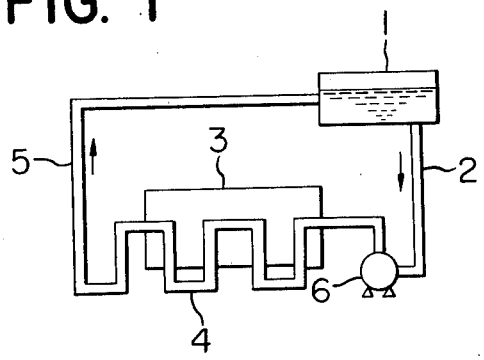
FIG. 1 is a schematic drawing of the conventional evaporative cooling method using forced circulation.
Figure 2:
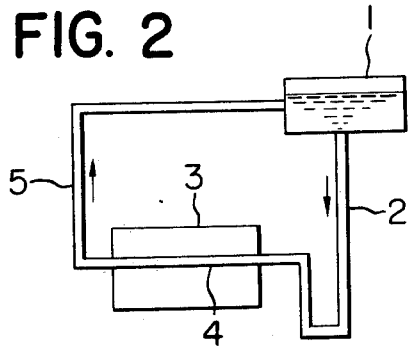
FIG. 2 is a schematic drawing of the conventional evaporative cooling method using natural circulation.
Figure 3:
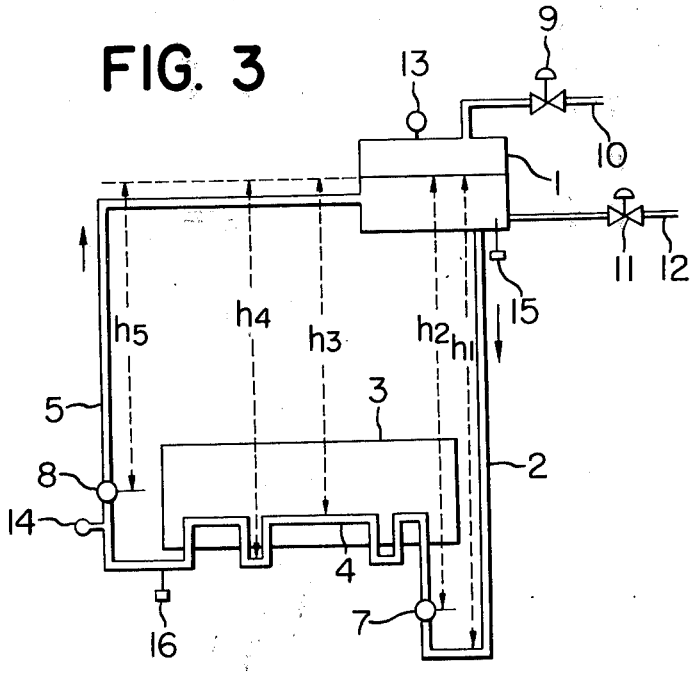
FIGS. 3, 4, 5, 6, 8(A), 10 and 13 are schematic drawings which show various embodiments of the method of this invention.

Referring first to FIG. 3, the first embodiment of this invention is described. In the drawing, 1 designates a steam separator drum, 2 designates a downcomer, 3 designates an object to be cooled such as a blast furnace and a heating furnace, 4 designates a cooling pipe fitted to said object to be cooled, 5 designates a riser, 7 designates a downcomer header, 8 designates a riser header, 9 designates a steam valve, 10 designates a steam exhaust pipe, 11 designates a water feed valve, 12 designates a water feed pipe, 13 designates a steam separator drum manometer, 14 designates a cooling pipe outlet manometer, 15 designates a steam separator drum thermometer, 16 designates a cooling pipe outlet thermometer, and $h_1 - h_5$ designate the heights from the following positions to the level of cooling water in said steam separator drum 1.

$h_1$: Lowermost part of said downcomer 2
$h_2$: Downcomer header 7
$h_3$: Uppermost part of said cooling pipe 4
$h_4$: Lowermost part of said cooling pipe 4
$h_5$: Riser header 8.

Although there are cases where many cooling pipe systems are used and a plurality of downcomers, cooling pipes and risers are employed, a case where one downcomer 2, one cooling pipe 4 and one riser 5 are used is first described for a better understanding of the description.

Cooling water flows down from a steam separator drum 1 through a downcomer 2 into a cooling pipe 4, where said cooling water is heated through heat exchange with an object to be cooled 3. Said cooling water then enters a riser 5, where part of said cooling water evaporates and returns to said steam separator drum 1 in the gaseous and aqueous states. The steam separated by said steam separator drum 1 from said cooling water is discharged through a steam value 9 from a steam exhaust pipe 10 to outside the circuit. Cooling water in the liquid state again circulates through the above-mentioned circulation route. Cooling water is totally replenished from outside the circuit through a water feed pipe 12 and a water feed valve 11 to said steam separator drum 1 in an amount corresponding to the quantity of the steam discharged to outside the circuit. In this constant state, supposing:

Q(Kcal/hr): Thermal load acting on said cooling pipe 4
V($Nm^3$/hr): Amount of circulated cooling water in said cooling pipe 4
$P_o$(kg/$cm^2$): Pressure in said steam separator drum 1

Figure 7:
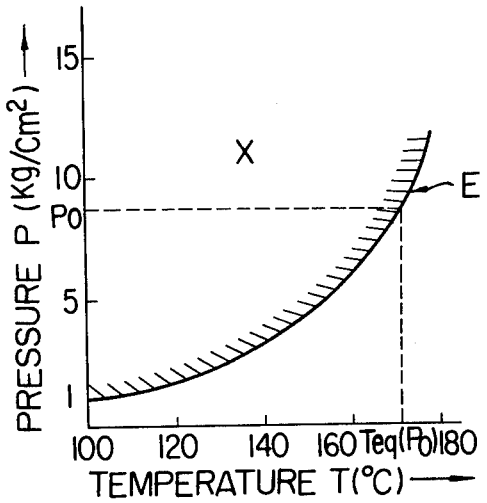
FIG. 7 is a graph which shows a boiling equilibrium curve.

Then, the temperature $T_o$, of cooling water in said steam separator drum 1, given by the following equation (1), corresponds to the temperature, $T_{eq}(P_o)$, in equilibrium with, $P_o$, according to the boiling equilibrium shown in FIG. 7:

$$T_o = T_{eq}(P_o) \quad (1)$$

Supposing that there is no change in the heat balance for said downcomer 2, the temperature, $T_{in}$, of cooling water at the inlet of said cooling pipe 4 is given by the following equation (2):

$$T_{in} = T_o = T_{eq}(P_o) \quad (2)$$

When the cooling water in said cooling pipe 4 does not evaporate, thermal load, Q, corresponds to the rise of the temperature of cooling water at the outlet of said cooling pipe 4. Therefore, the temperature, $T_{out}$, of cooling water at the outlet of said cooling pipe 4 is given by the following equation (3):

$$T_{out} = T_{in} + Q/V \cdot \beta \cdot c \quad (3)$$

Where, $\rho$: Density of cooling water (Kg/Nm$^3$)

$c$ : Specific heat of cooling water (Kcal/kg)

The condition which precludes the evaporation of cooling water in said cooling pipe 4 is that the relation between the pressure and the temperature of cooling water in said cooling pipe 4 is within the range, X, above the boiling equilibrium curve, E, shown in FIG. 7; that is, the temperature of cooling water in said cooling pipe 4 is lower than the temperature, Teq($P_o$), in equilibrium with the pressure of cooling water in said cooling pipe 4. In cases where a bend portion composed of an ascending part and a descending part is included in said cooling pipe 4, the static pressure of cooling water in said cooling pipe 4 is lower in the uppermost part, $h_3$, thereof than in the lowermost part, $h_4$, thereof. Therefore, if the steam of cooling water is not generated in said uppermost part, $h_3$, the steam of cooling water is generated nowhere in said cooling pipe 4. When the cooling water in said cooling pipe 4 does not evaporate, the flow of cooling water in said cooling pipe 4 takes place only in the liquid state and pressure loss due to fluid resistance is minimum. Therefore, the pressure, $Ph_3$, of cooling water in the uppermost part, $h_3$, of said cooling pipe 4 in this case is expressed by the following equation:

$$Ph_3 = P_o + \rho \cdot g h_3 \quad (4)$$

Where, $g$: Gravity conversion factor

If the temperature of cooling water in said cooling pipe 4, which is in equilibrium with pressure, $Ph_3$, is expressed by $T_{eq}$ ($Ph_3$), the condition of the temperature, $T_{out}$, of cooling water at the outlet of said cooling pipe 4, which precludes the evaporation of cooling water in said cooling pipe 4, is given by the following equation:

$$T_{out} < T_{eq}(Ph_3) \quad (5)$$

Therefore, the following relation is given by Eqs. (3) and (5):

$$T_{in} + Q/V \cdot c < T_{eq}(Ph_3) \quad (6)$$

And the boiling equilibrium temperature difference, $T_{eq}$ ($P_o$, $Ph_3$), between $P_o$, and, $Ph_3$, is given by the following equation:

$$\Delta T_{eq}(Po, Ph_3) = T_{eq}(Ph_3) - T_{eq}(P_o) \quad (7)$$

Eq. (6) is transformed as follows by the use of Eqs. (2) and (7):

$$T_{eq}(P_o) + Q/V \cdot \rho \cdot c < T_{eq}(P_o) + \Delta T_{eq}(P_o, Ph_3) \quad (8)$$
$$Q/V \cdot \rho \cdot c < \Delta T_{eq}(Po, Ph_3) \quad (9)$$

Therefore, the following equation is given by Eq. (4):

$$Q/V \cdot \Delta \cdot c < \Delta T_{eq}(Po, P_o + \rho \cdot g h_3) \quad (10)$$

Accordingly, if parameters such as $Q$, $V$, $P_o$ and $h_3$ are so set as to satisfy Eq. (10), the evaporation of cooling water does not take place in said cooling pipe 4, but takes place only in said riser 5 and in said steam separator drum 1. To be concrete, the following methods are preferable for precluding the evaporation of cooling water in said cooling pipe 4:

a. To increase the amount of circulated cooling water in said cooling pipe 4 by enlarging diameters of said downcomer 2, said cooling pipe 4, said riser 5, etc.

b. To limit the thermal load acting on said cooling pipe 4 to a relatively low value or to reduce the length of said cooling pipe 4.

c. To increase the boiling equilibrium temperature difference, $\Delta T_{eq}(P_o, Ph_3)$. More specifically, in consideration of the boiling equilibrium characteristics, it is desirable to decrease the pressure, $P_o$, in said steam separator drum 1 or to decrease the pressure of cooling water in said cooling pipe 4 by increasing the height, $h_3$, of said steam separator drum 1.

The amount of circulated cooling water, V, in said cooling pipe 4 depends upon the balance between the following two factors: one is the circulation force generated by the difference in density between the cooling water in said downcomer 2 in the liquid state and the cooling water in said riser 5 in the gaseous and aqueous states; and the other is the fluid resistance of cooling water in said downcomer 2, said cooling pipe 4 and said riser 5 in the liquid state and the gaseous and aqueous states. Since the cooling water evaporation onset position and the specific gravity of cooling water are dependent on the cooling water pressure, the amount of circulated cooling water in said cooling pipe 4 varies with the pressure, $P_o$, in said steam separator drum 1, the height, $h_3$, of said steam separator drum 1, the lengths and diameters of said downcomer 2, said cooling pipe 4 and said riser 5, etc.

Figure 4:
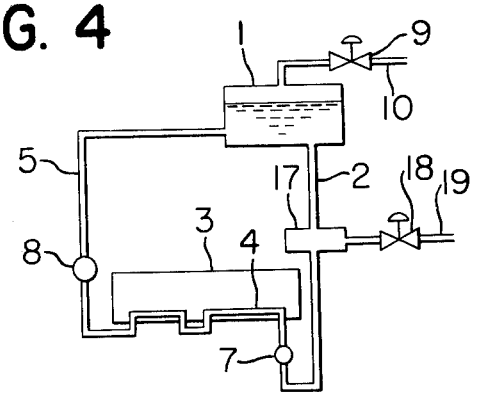

Next, the second embodiment of this invention is described with reference to FIG. 4. In the drawing, 1 designates a steam separator drum, 2 designates a downcomer, 3 designates an object to be cooled, 4 designates a cooling pipe, 5 designates a riser, 7 designates a downcomer header, 8 designates a riser header, 9 designates a steam valve, 10 designates a steam exhaust pipe, 17 designates an auxiliary drum for supplementary water feed, 18 designates a supplementary water feed valve, and 19 designates a supplementary water feed pipe.

In the same manner as in the first embodiment of this invention, cooling water flows down from a steam separator drum 1 through a downcomer 2 into a cooling pipe 4, where said cooling water is heated through heat exchange with an object to be cooled 3. Said cooling water enters then a riser 5, where part of said cooling water evaporates and returns to said steam separator drum 1 in the gaseous and aqueous states. The steam separated by said steam separator drum 1 from said cooling water is discharged through a steam valve 9 from a steam exhaust pipe 10 to outside the circuit. Cooling water in the liquid state again circulates through the above-mentioned circulation route. Cooling water is totally replenished from outside the circuit through a supplementary water feed pipe 19, a supplementary water feed valve 18 and an auxiliary drum for supplementary water feed 17 to the middle of said downcomer 2 in an amount corresponding to the quantity of the steam discharged from the circuit. As is apparent from the foregoing, the second embodiment of this invention differs from the first embodiment mentioned above in replenishing cooling water totally to the middle of said downcomer 2 in an amount corresponding to the quantity of the steam discharged to outside the circuit.

Already mentioned, to increase the boiling equilibrium temperature of cooling water in said cooling pipe by setting said steam separator drum in a sufficiently high position is one of the methods of precluding the evaporation of cooling water in said cooling pipe in the evaporative cooling method by natural circulation. However, it is difficult from the standpoint of the design of the apparatus to set said steam separator drum in a limitlessly high position. Besides, there are cases where it is impossible to set the steam separator drum in a sufficiently high position because of the restrictions in layout of the whole equipment.

In such cases, the evaporation of cooling water in said cooling pipe can be precluded even if the position of said steam separator drum is relatively low, by replenishing cooling water from outside the circuit to the middle of said downcomer in an amount corresponding to the quantity of the steam discharged to outside the circuit instead of replenishing cooling water from outside the circuit to said steam separator drum as in the first embodiment mentioned above.

Figure 12:
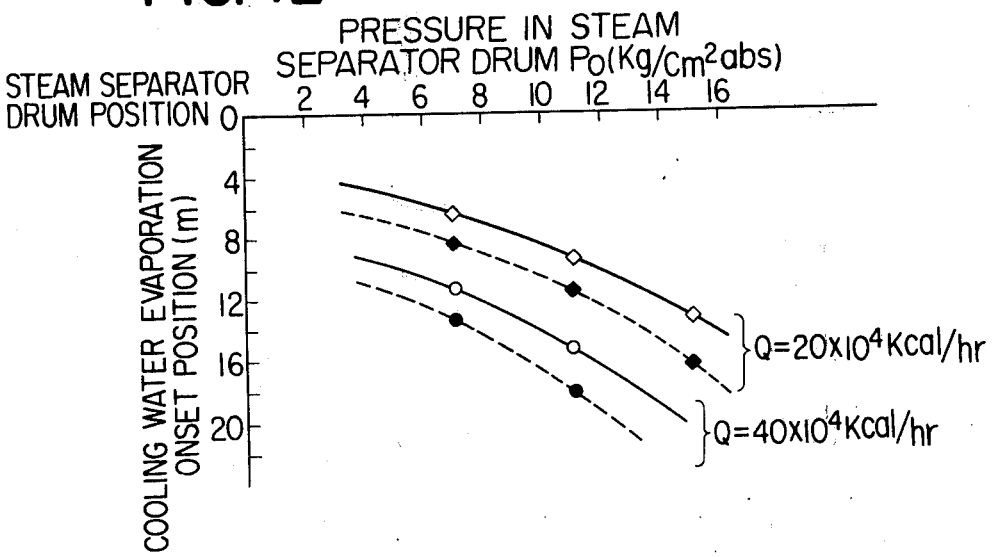

As previously mentioned, the temperature, $T_{out}$, of cooling water at the outlet of said cooling pipe increases with increased thermal load, Q, acting on said cooling pipe (see the above Eq. (3) ), leading to gradually lower evaporation onset position of cooling water in said riser. And even if the temperature rise ($T_o - T_{eq}(P_o)$ ) of the cooling water in said cooling pipe does not change, the boiling equilibrium temperature difference, $\Delta T_{eq}$ ($P_o$, $Ph_3$), between $P_o$, and $Ph_3$, decreases with increased pressure, $P_o$, in said steam separator drum (see the above Eqs. (7) and (9) ), similarly leading to gradually lower evaporation onset position of cooling water in said riser. The evaporation onset position in this case corresponds to a position where a pressure corresponding to, $T_{out}$, is prevalent according to the boiling equilibrium curve shown in FIG. 7. In FIG. 12, the dotted lines indicate, for the second embodiment of this invention, the interrelation between the pressure in said steam separator drum, the thermal load acting on said cooling pipe and the evaporation onset position of cooling water in said riser.

If the amount of steam generated in said riser is expressed by G kg/hr and the evaporation latent heat at the pressure, $P_o$, in said steam separator drum is expressed by $q$ Kcal/kg, the following equation stands:

$$G = Q/q \tag{11}$$

For the purpose of maintaining the level of cooling water and the pressure in said steam separator drum, cooling water is replenished in an amount corresponding to the quantity of the steam discharged from said steam separator drum to outside the circuit. First, the case where cooling water is replenished totally to said steam separator drum is described. Steam generated in said riser effects heat exchange with said cooling water replenished in said steam separator drum, and part of the steam is liquefied on this occasion. If the amount of steam discharge to outside the circuit is expressed by $G_1$ kg/hr and the temperature of said supplementary water (the amount of which corresponds to $G_1$) is expressed by $T_w$, the following equations stand.

$$G_1 < G \tag{12}$$

$$q(G - G_1) = G_1 c(T_{eq}(P_o) - T_w) \tag{13}$$

Where, $c$: Specific heat of cooling water

Therefore, the following equation stands according to Eqs. (11) and (12):

$$G_1 = qG/[c(T_{eq}(P_o) - T_w) + q] = Q/[c(T_{eq}(P_o) - T_w) + q] \tag{14}$$

Next, the case where cooling water is replenished totally to the middle of said downcomer is described with reference to FIG. 4. Cooling water is replenished totally to the middle of said downcomer 2 through a supplementary water feed pipe 19, a supplementary water feed valve 18 and an auxiliary drum for supplementary water feed 17. Since the temperature in said steam separator drum 1 is an equilibrium boiling temperature, steam generated in a riser 5 is not liquiefied and is discharged totally through a steam valve 9 and a steam exhaust pipe 10 to outside the circuit. Therefore, if the amount of steam generated in said riser 5 is expressed by $G_2$ kg/hr and the amount of steam discharged to outside the circuit is expressed by $G_3$ kg/hr, the following equation stands:

$$G_2 = G_3 \tag{15}$$

The heat balance in this case is as follows:

$$G_3 c (T_{eq}(P_o) - T_w) + G_2 q = Q \tag{16}$$

Therefore, the following equation stands:

$$G_3 = Q/c(T_{eq}(P_o) - T_w) + q \tag{17}$$

Accordingly, in the first embodiment of this invention mentioned above, or in the case where cooling water is totally replenished to the steam separator drum, the relation between the amount of steam, $G$, generated in the riser and the amounts of steam discharged, $G_1$, $G_2$, and $G_3$ is given by the following equation:

$$G_3 = G_2 = G_1 < G \tag{18}$$

This means that the thermal load, Q, acting on the cooling pipe totally contributes to the generation of steam in the first embodiment of this invention mentioned above. On the contrary, since the temperature of cooling water at the inlet of the cooling pipe decreases in the second embodiment, part of the thermal load, Q, is used to raise the temperature of supplementary water in the cooling pipe to a temperature in equilibrium with the predetermined pressure in the steam separator drum. Therefore, the amount of steam generated in the riser is small as compared with that in the first embodiment of this invention.

Accordingly, in the second embodiment, the steam separator drum can be set in a lower position than in the first embodiment. Besides, there is less possibility of generation of steam in the cooling pipe than in the first embodiment, even if the thermal load abruptly fluctuates, e.g., due to falling off of heat insulator pieces from the periphery of the cooling pipe.

The table below shows an example of comparison of amounts of steam generated in the risers in the first and second embodiments of this invention. This table illustrates a comparison of amounts of generated steam in terms of thermal loads per cooling pipe. As is apparent from this table, the amount of steam generated in this second embodiment is smaller than in the first embodiment by about 20% to about 30%.

| Pressure in Steam Separator Drum | Thermal Load: $20 \times 10^4$ | | Thermal Load: $40 \times 10^4$ Division | | Thermal Load: $60 \times 10^4$ | |
|---|---|---|---|---|---|---|
| | 1st embodiment | 2nd embodiment | 1st embodiment | 2nd embodiment | 1st embodiment | 2nd embodiment |
| 1 | 371 | 324 | 757 | 647 | 1,135 | 971 |
| 3 | 387 | 317 | 774 | 635 | 1,161 | 952 |
| 5 | 397 | 315 | 794 | 630 | 1,190 | 945 |
| 7 | 405 | 313 | 810 | 627 | 1,215 | 940 |
| 11 | 418 | 312 | 837 | 624 | 1,255 | 936 |
| 16 | 432 | 311 | 864 | 622 | 1,296 | 933 |

Units:
Thermal load: Kcal/hr
Pressure in steam separator drum: kg/cm² abs.
Amount of generated steam: kg/hr Next, the third embodiment of this invention is described with reference to FIG. 5. In the drawing, 1 designates a steam separator drum, 2 designates a downcomer, 3 designates an object to be cooled, 4 designates a cooling pipe, 5 designates a riser, 7 designates a downcomer header, 8 designates a riser header, 9 designates a steam valve, 10 designates a steam exhaust pipe, 11 designates a water feed valve, 12 designates a water feed pipe, 17 designates an auxiliary drum for supplementary water feed, 18 designates a supplementary water feed valve, 19 designates a supplementary water feed pipe, and 20A and 20B designate vapor volumn percentage measuring devices.

The third embodiment of this invention differs from the first and second embodiments mentioned above in that the cooling water is replenished by distributing it to both said steam separator drum 1 and the middle of said downcomer 2 in an amount corresponding to the quantity of steam discharged from said steam separator drum 1 to outside the circuit.

If cooling water is totally replenished to the middle of the downcomer as in the second embodiment of this invention under a small thermal load acting on the cooling pipe, the temperature distribution of cooling water in the circuit largely fluctuates and pulsates because the temperature of supplementary water is as low as about 15° to about 25° C, and it takes long to recover the constant state. On the contrary, if cooling water is totally replenished to the steam separator drum as in the first embodiment of this invention, the temperature distribution of cooling water in the circuit has smaller fluctuations and has a shorter pulsation period, because the steam separator drum has a larger capacity and the circulation ratio, i.e., the ratio of the amount of discharged steam in kg/hr to the amount of circulated cooling water in kg/hr, is about 100. Besides, as already mentioned, the evaporation onset position of cooling water in the riser becomes lower as the thermal load acting on the cooling pipe becomes larger. Thus, the circulation of cooling water varies with the changes in thermal load acting on the cooling pipe. However, the fluctuations of evaporation onset position of cooling water in the riser can be minimized and the smooth operation can be ensued by measuring the evaporation onset position of cooling water in the riser and regulating, by program setting or manually, the amount of cooling water replenished to the steam separator drum and the middle of the downcomer.

Figure 5:
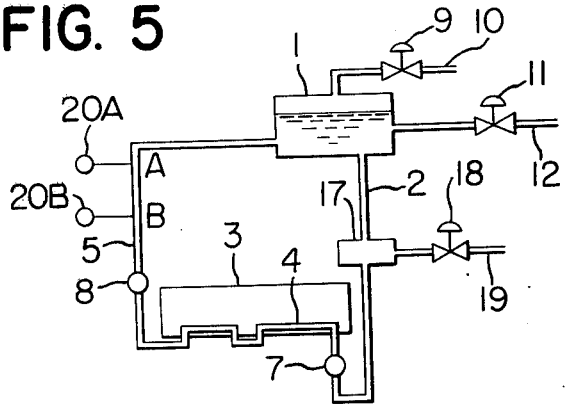

More specifically, as shown in FIG. 5, vapor volume percentage measuring devices 20A and 20B are installed at point A, the upper limit for setting the evaporation onset position of cooling water in the riser, and at point B, the lower limit for the same, respectively, to measure as to whether or not the cooling water passing points A and B contains vapor and to regulate the amount of cooling water replenished to the steam separator drum 1 and to the middle of the downcomer 2 as follows:

a. When the cooling water passing point A is free of steam and is in a complete liquid state, cooling water is replenished only to said steam separator drum 1 through a water feed pipe 12 and a water feed valve 11.

b. When the cooling water passing point A is in gaseous and aqueous states, and the cooling water passing point B is free of steam and is in complete liquid state, cooling water is replenished by distributing in a specific ratio to both said steam separator drum 1 and the middle of said downcomer 2, through the feed pipe 12 and the feed valve 11, and through a supplementary water feed pipe 19, a supplementary water feed valve 18 and an auxiliary drum for supplementary water feed 17, respectively.

c. When the cooling water passing point B is in gaseous and aqueous states, cooling water is replenished only to the middle of said downcomer 2 through said supplementary feed pipe 19, said supplementary feed valve 18 and said auxiliary drum for supplementary feed 17.

The circulation of cooling water can be kept substantially constant by adopting above-mentioned methods of replenishing cooling water even if the thermal load acting on the cooling pipe abruptly fluctuates. Replenishing of cooling water may be regulated by measuring the pressure and temperature of cooling water at points A and B to get information about the presence of steam in cooling water, instead of using said steam volume percentage measuring devices.

Figure 13:
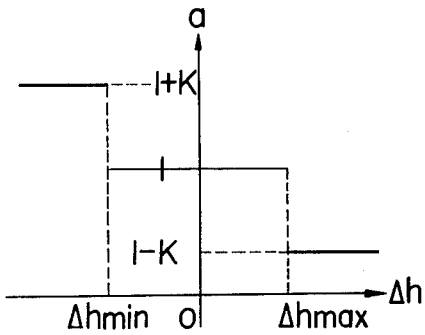

As previously mentioned, although the level of cooling water in the steam separator drum can be maintained constant by replenishing of cooling water in an amount corresponding to the quantity of the steam discharged from the steam separator drum, the replenishing of cooling water to the middle of the downcomer results in larger fluctuations of the amount of circulated cooling water. However, it is possible to continuously replenish cooling water and to mimimize fluctuations of the amount of circulated cooling water by: detecting the actual level of cooling water in the steam separator drum; calculating the difference, $\Delta h$, between the actual level and the predetermined level; assuming;

[amount of replenished] = $a$·[amount of discharged steam]

and controlling the value of, $a$, as follows relative to the upper limit, $\Delta h_{max}$, of $\Delta h$ and the lower limit, $\Delta h_{min}$, of $\Delta h$:

a. when $\Delta h < \Delta h_{min} : a = 1 + k$,
b. when $\Delta h_{min} \leqq \Delta n \leqq \Delta h_{max} : a = 1$
c. when $\Delta h < \Delta h_{max} : a = 1 - k$ In this procedure, a preferable range of, $k$, is from 0.1 to 0.2. FIG. 13 illustrates the relation between, $\Delta h$, and, $a$, and FIG. 6 shows part of a device for embodying this method. in FIG. 6, 1 designates a steam separator drum, 2 designates a downcomer, 5 designates a riser, 9 designates a steam valve, 10 designates a steam exhaust pipe, 11 designates a water feed valve, 12 designates a water feed pipe, 17 designates an auxiliary drum for supplementary water feed valve, 19 designates a supplementary water feed pipe, 21 designates a steam flow meter, 22 designates a water level gauge, and 23 designates a program setting unit.

Figure 6:
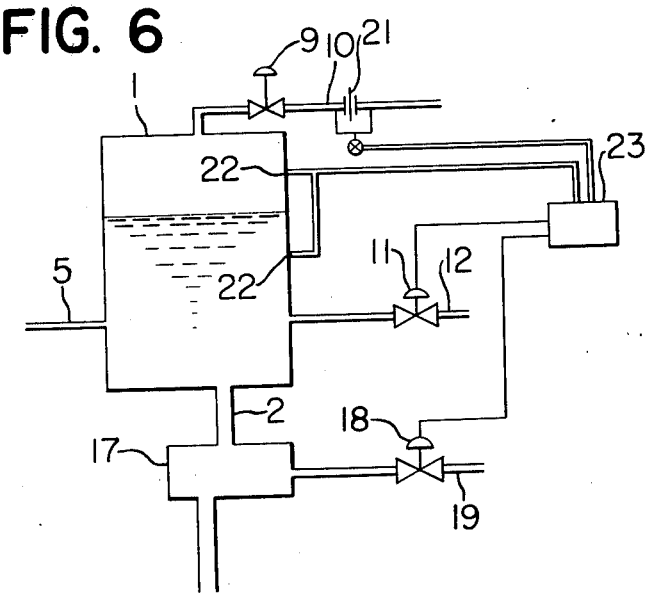

In FIG. 6, the amount of discharged stream, i.e., the amount of cooling water to be replenished is measured by a steam flow meter 21, and the measured value, $v$, is put into a program setting unit 23. The difference between the level of cooling water in a steam separator drum 1 and a predetermined level is measured by a water level gauge 22 from the difference in pressure between above and below the level of cooling water in said steam separator drum 1, and the measured value, $\Delta h$, is put into said program setting unit 23. The above-mentioned judgement criteria (a), (b) and (c) are stored beforehand in said program setting unit 23. Said program setting unit 23 puts out actuation signals to a water feed valve 11 and a supplementary water feed valve 18 using said measured value, $v$, $\Delta h$, and said judgement criteria. The amount of water replenished to said steam separator drum and the middle of said downcomer 2 corresponding to the quantity of discharged steam is regulated in this manner so that the level of cooling water in said steam separator drum 1 can be always kept constant.

Next, the method of this invention is described in more detail with reference to some examples.

EXAMPLE 1

Figure 8A:
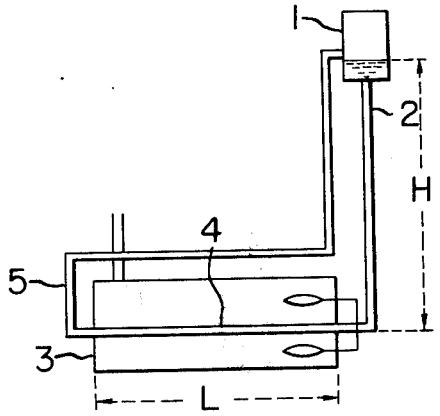

Example 1 is an example of the first embodiment of this invention, wherein cooling water is totally replenished to a steam separator drum. FIG. 8(A) shows the outline of a test apparatus of this embodiment. In the drawing, 1 designates a steam separator drum, 2 designates a downcomer, 3 designates an object to be cooled (a heating furnace), 4 designates a cooling pipe, and 5 designates a riser. In the test, said downcomer 2 had a length H of 18m and a diameter of 65mm, and said cooling pipe 4 had a length L of 6m and a diameter of 65mm. Results of the test revealed that the evaporation of cooling water did not occur in said cooling pipe 4 but occurred only in said riser 5 and said steam separator drum 1.

Figure 8B:
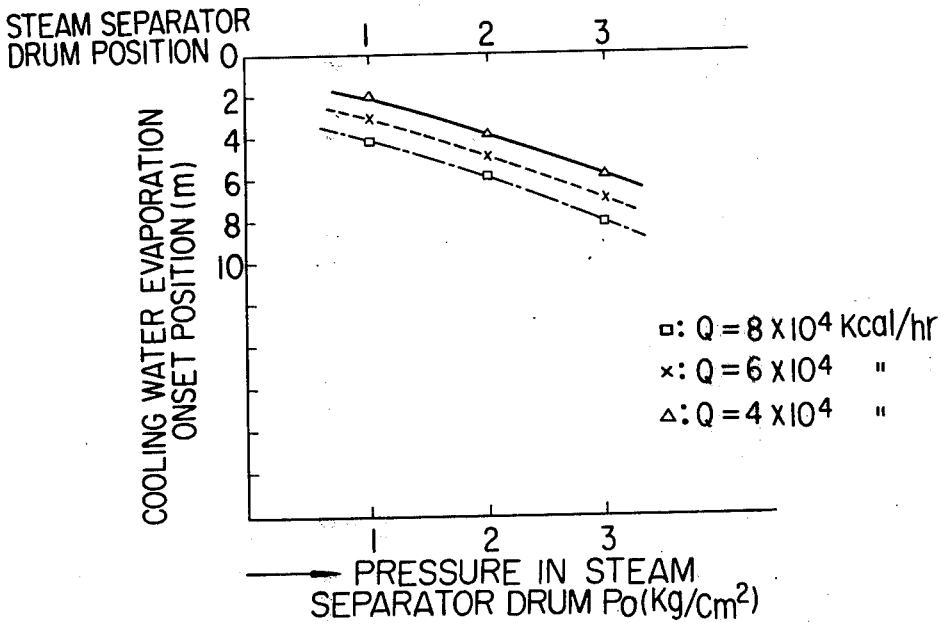
FIGS. 8(B), 9, 11 and 12 are graphs which show the results of testing of various embodiments of the method according to this invention.

FIG. 8(B) is a graph which shows the results of the above-mentioned test and illustrates the interrelation between the pressure, $P_o$, in said steam separator drum 1, the thermal load, Q, acting on said cooling pipe 4 and the evaporation onset position, $m$, of cooling water in said riser 5. In the graph, the combination of signs, Δ, and a solid line represents a thermal load, Q, of $4 \times 10^4$ Kcal/hr, the combination of signs, $x$, and a dotted line represents a thermal load, Q, of $6 \times 10^4$ Kcal/hr, and the combination of signs, □ , and a one-point chain line represents a thermal load, Q, of $8 \times 10^4$ Kcal/hr. The thermal loads, Q, were calculated from the amount of circulated cooling water, V, and measured values of the temperature of cooling water at the inlet and outlet of said cooling pipe 4. The evaporation onset position of cooling water in said riser 5, i.e., the distance from said steam separator drum 1, was calculated from measured values of the temperature of cooling water at the outlet of said cooling pipe 4 and from indication temperature given by thermocouples installed at intervals of $2m$ in said riser 5 and was, at the same time, visually confirmed through peep holes provided at intervals of $2m$ in said riser 5. The calculations and the visual measurements were well consistent.

As is apparent from FIG. 8(B), the smaller the pressure, $P_o$, in said steam separator drum 1 is and the smaller the thermal load, Q, on said cooling pipe 4 is, the higher is the evaporation onset position of cooling water in said riser 5, that is, the smaller is the distance from said steam separator drum 1.

EXAMPLE 2

Example 2 is another example of the first embodiment of this invention. The test apparatus shown in FIG. 8(A) was used. In the test, the downcomer 2 had a length H of 20m and a diameter of 200mm, and the cooling pipe 4 had a length L of 20m and a diameter of 100mm.

Figure 9:
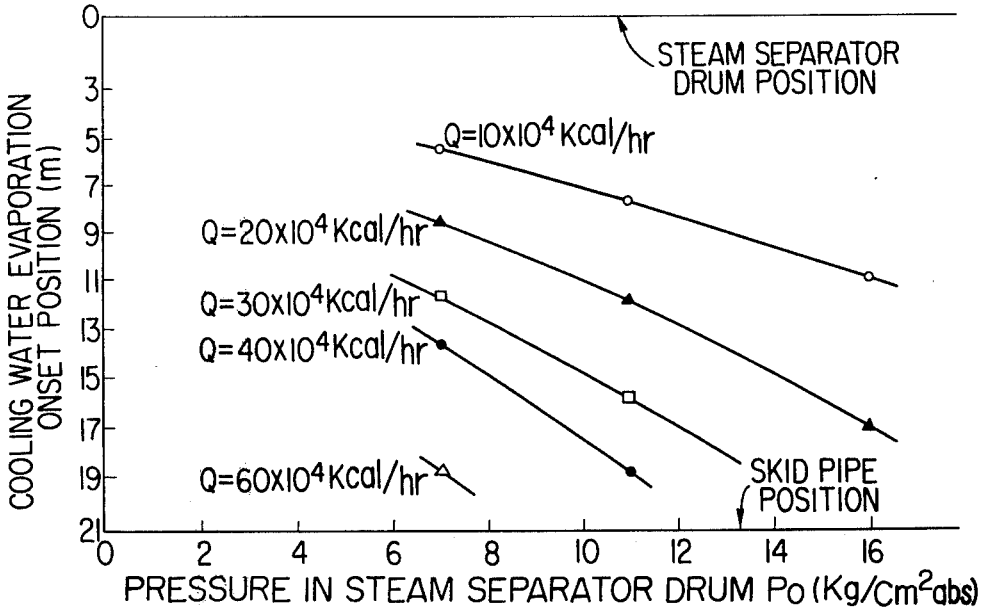

FIG. 9 is a graph which shows the results of the above-mentioned test and illustrates the interrelation between the pressure, $P_o$, in said steam separator drum 1, the thermal load, Q, acting on said cooling pipe 4 and the evaporation onset position, $m$, of cooling water in said riser 5. In the graph, the combination of signs, $o$, and a solid line represents a thermal load, Q, of $10 \times 10^4$ Kcal/hr, the combination of signs, ▲, and a solid line represents a thermal load, Q, of $20 \times 10^4$ Kcal/hr, the combination of signs, □ , and a solid line represents a thermal load, Q, of $30 \times 10^4$ Kcal/hr, the combination of signs, ● , and a solid line represents a thermal load, Q, of $40 \times 10^4$ Kcal/hr, and the combination of signs, Δ, and a solid line represents a thermal load, Q, of $60 \times 10^4$ Kcal/hr.

As is evident from FIG. 9 although larger thermal loads, Q, than in Example 1 were used in Example2, the evaporation of cooling water did not occur in said cooling pipe 4, with satisfactory results.

EXAMPLE 3

Example 3 is an example of the second embodiment of this invention, wherein cooling water is totally replenished to the middle of a downcomer. FIG. 4 shows an outline of the apparatus embodied in accordance with this invention. The description of the drawing is omitted here to avoid duplication with that hereinbefore. In the test, the height from the level of cooling water in the stream separator drum 1 to the uppermost part of the cooling pipe 4 was 18m, the predetermined pressure in the steam separator drum 1 was 3 kg/cm² abs, and the length of the cooling pipe 4 was 6m.

Figure 11:
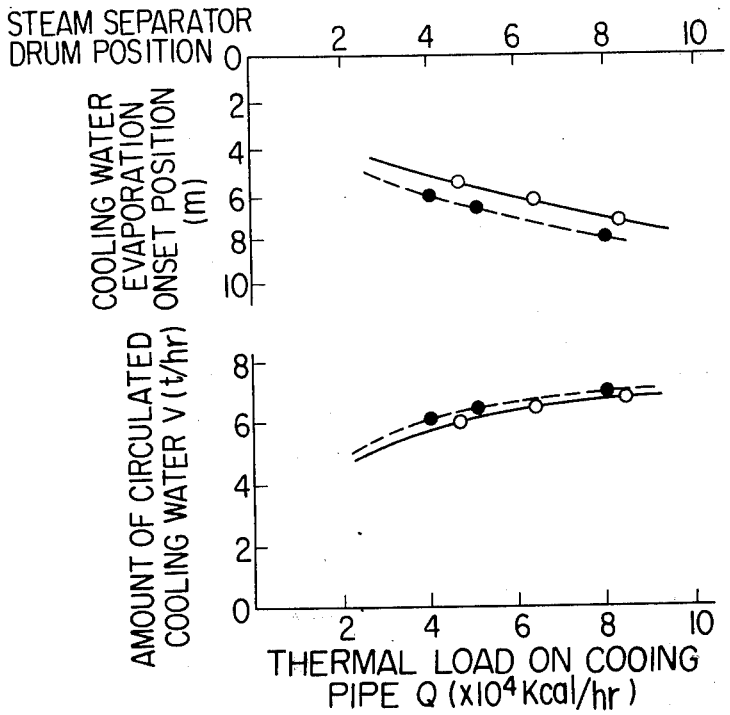

In FIG. 11, the solid lines represent the results of the above-mentioned test and the dotted lines represent, for comparison, the results of test of a case where cooling water is totally replenished to the steam separator drum. As is apparent from the drawing, when cooling water is replenished to the middle of the downcomer, the evaporation onset position of cooling water in the riser is higher and the amount of circulated cooling water in the riser is higher and the amount of circulated cooling water is smaller than in the case where cooling water is replenished to the steam separator drum.

FIG. 12 is a graph which shows the results of test in which different pressures, $P_o$, in the steam separator drum and different thermal loads, Q, acting on the cooling pipe were used. In the graph, the solid lines represent cases where cooling water was totally replenished to the middle of the downcomer, and the dotted lines represent, for comparison, cases where cooling water was totally replenished to the steam separator drum. As is apparent from the graph, when cooling water is replenished to the middle of the downcomer, the evaporation onset position of cooling water in the riser is about 3m higher than in the cases where cooling water is replenished to the steam separator. Therefore, the position of the steam separator drum can be lowered about 3m.

Figure 10:
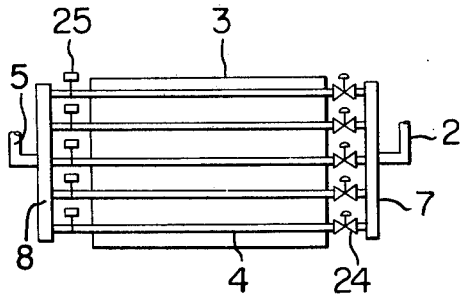

So far, only cases where one cooling pipe is used have been described. However, a number of cooling pipes are used, for example, in a heating furnace, and there are cases where these cooling pipes have different lengths and different diameters, and the amount of circulated cooling water and the outlet temperature are different between cooling pipes, with uneven thermal loads acting on cooling pipes. Therefore, since there can be cooling pipes in which the evaporation of cooling water takes place, it is desirable to take measures to preclude evaporation of cooling water in every cooling pipe. An example of the measures is shown in FIG. 10.

As is shown in the drawing, a flow rate regulating valve 24 is provided between a downcomer header 7 and each cooling pipe 4, and an outlet thermometer 25 is provided between a riser header 8 and each of said cooling pipes 4. And the flow rate of cooling water in each of said cooling pipes 4 is regulated by measuring the outlet temperature of cooling water in each of said cooling pipes 4 with said outlet thermometer 25 and by manipulating said flow rate regulating valve 24 so that the outlet temperatures of cooling water in said cooling pipes 4 are substantially equal. Since thermal fluctuations of a heating furnace are in general relatively small and time constants are large, manual regulations suffice. If the outlet temperature of cooling water in each of said cooling pipes 4 is regulated to below the boiling equilibrium temperature in this manner, the evaporation of cooling water can be precluded in every cooling pipe and the method of this invention can be applied in the above-mentioned various embodiments also in cases where a number of cooling pipes are used.

According to this invention as amplified above, since steam of cooling water is not generated in a cooling pipe provided with a bend portion composed of an ascending part and a descending part, the evaporative cooling method by natural circulation of cooling water can be adopted in cases where a cooling pipe is provided with said bend portion, thus leading to a substantial reduction in equipment cost and running cost. Further, a high degree of safety can be ensured even if the thermal load acting on a cooling pipe abruptly fluctuates due to electric power failure or other causes, thus producing industrially useful effect.

What is claimed is:

1. Evaporative cooling method by natural circulation of cooling water comprising the steps of using an evaporative cooling device comprising a cooling pipe fitted to an object to be cooled and a steam separator drum arranged above said cooling pipe, said cooling pipe and said steam separator drum being connected together by a downcomer and a riser, separating steam generated within the circuit of said evaporative cooling device from cooling water by means of said steam separator drum, discharging said steam to outside the circuit, totally replenishing cooling water from outside the circuit to the middle of said downcomer in an amount corresponding to the quantity of the discharged steam, keeping the cooling water in said cooling pipe in complete liquid state and causing part of cooling water to evaporate only in said riser and in said stream separator drum by setting parameters to satisfy the following formula:

$$Q/V \cdot \rho \cdot c < \Delta T_{eq}\,(P_o, Ph_3)$$

Where, $Q$:Thermal load acting on said cooling pipe $V$:Amount of circulated cooling water in said cooling pipe $\rho$:Density of cooling water $c$:Specific heat of cooling water $P_o$:Pressure in said steam separator drum $Ph_3$:Pressure of cooling water in uppermost part of said cooling pipe $\Delta T_{eq}\,(P_o, Ph_3)$:Boiling equilibrium temperature difference between $P_o$ and $Ph_3$.

2. The method of claim 1, wherein said cooling pipes are used in the number of at least two, characterized by providing a flow rate regulating valve for cooling water at the inlet of each of said cooling pipes, providing an outlet thermometer for cooling water at the outlet of each of said cooling pipes, measuring the temperature of cooling water at the outlet of each of said cooling pipes, and regulating the flow rates of cooling water in each of said cooling pipe with said flow rate regulating valve so that the temperatures of cooling water at the outlets of said cooling pipes are substantially equal.

3. Evaporative cooling method by natural circulation of cooling water comprising the steps of using an evaporative cooling device comprising a cooling pipe fitted to an object to be cooled and a steam separator drum arranged above said cooling pipe, said cooling pipe and said steam separator drum being connected together by a downcomer and a riser, separating steam generated within the circuit of said evaporative cooling device from cooling water by means of said stream separator drum, discharging said steam to outside the circuit, replenishing cooling water from outside the circuit by distributing said cooling water to both said steam separator drum and the middle of said downcomer, the cooling water being replenished in a total amount corresponding to the quantity of the discharged steam, keeping the cooling water in said cooling pipe in complete liquid state and causing part of cooling water to evaporate only in said riser and in said steam separator drum by setting parameters to satisfy the following formula:

$$Q/V \cdot \rho \cdot c < \Delta T_{eq}\,(P_o, Ph_3)$$

Where, $Q$:Thermal load acting on said cooling pipe $V$:Amount of circulated cooling water in said cooling pipe $\rho$:Density of cooling water
$c$:Specific heat of cooling water
$P_o$:Pressure in said steam separator drum
$Ph_3$:Pressure of cooling water in uppermost part of said cooling pipe
$\Delta T_{eq}$ ($P_o$, $Ph_3$):Boiling equilibrium temperature difference between $P_o$ and $Ph_3$.

4. The method of claim 3, wherein said cooling pipes are used in the number of at least two, characterized by providing a flow rate regulating valve for cooling water at the inlet of each of said cooling pipes, providing an outlet thermometer for cooling water at the outlet of each of said cooling pipes, measuring the temperature of cooling water at the outlet of each of said cooling pipes, and regulating the flow rates of cooling water in each of said cooling pipe with said flow rate regulating valve so that the temperatures of cooling water at the outlets of said cooling pipes are substantially equal.

5. The method of claim 3, wherein the evaporation of cooling water is measured at two predetermined points in said riser for the regulation of the amounts of water replenished to both said steam separator drum and the middle of said downcomer according to said measured values.

6. The method of claim 3, wherein the level of cooling water in said steam separator drum is measured for the regulation of the amounts of water replenished to both said steam separator drum and the middle of said downcomer according to said measured values so that said level of cooling water in said steam separator drum always corresponds to a predetermined water level.

7. The method of claim 5, wherein said cooling pipes are used in the number of at least two, characterized by providing a flow rate regulating valve for cooling water at the inlet of each of said cooling pipes, providing an outlet thermometer for cooling water at the outlet of each of said cooling pipes, measuring the temperature of cooling water at the outlet of each of said cooling pipes, and regulating the flow rates of cooling water in each of said cooling pipe with said flow rate regulating valve so that the temperatures of cooling water at the outlets of said cooling pipes are substantially equal.

8. The method of claim 6, wherein said cooling pipes are used in the number of at least two, characterized by providing a flow rate regulating valve for cooling water at the inlet of each of said cooling pipes, providing an outlet thermometer for cooling water at the outlet of each of said cooling pipes, measuring the temperature of cooling water at the outlet of each of said cooling pipes, and regulating the flow rates of cooling water in each of said cooling pipe with said flow rate regulating valve so that the temperatures of cooling water at the outlets of said cooling pipes are substantially equal.

* * * * *